US005517728A

United States Patent [19]

Woods

[11] Patent Number: 5,517,728

[45] Date of Patent: May 21, 1996

[54] CABLE TIES

[75] Inventor: Derek Woods, Hazlemere, England

[73] Assignee: Thomas & Betts Corporation, Memphis, Tenn.

[21] Appl. No.: 369,597

[22] Filed: Jan. 6, 1995

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P

[56] References Cited

U.S. PATENT DOCUMENTS

| | | | |
|---|---|---|---|
| 3,186,047 | 6/1965 | Schwester et al. | 24/16 |
| 3,408,699 | 11/1968 | Reynolds | 24/16 PB |
| 3,457,598 | 7/1969 | Mariani | 24/16 PB |
| 3,588,961 | 6/1971 | Farago | 24/16 |
| 3,875,618 | 4/1975 | Schuplin | 24/16 PB |
| 3,892,011 | 7/1975 | Kohke | 24/16 PB |
| 5,121,524 | 6/1992 | Mortensen | 24/16 |
| 5,193,251 | 3/1993 | Fortsch | 24/30.5 P |

FOREIGN PATENT DOCUMENTS

| | | |
|---|---|---|
| 1186830 | 4/1970 | European Pat. Off. . |
| 1275650 | 8/1968 | Germany . |

*Primary Examiner*—Victor N. Sakran
*Attorney, Agent, or Firm*—Robert M. Rodrick

[57] ABSTRACT

A cable tie comprises a head and a strap of plastic material. The head has a transverse aperture formed therethrough and contains a separately formed barb. The barb has a head engaging portion and a strap engaging portion extending at least partly across the head aperture. The barb includes a flexure region comprising a pair of opposed cut-out portions each located in a edge of the barb to provide a section of reduced width between the cut-out portions. Each cut-out portion provides a shoulder at the side thereof such that after insertion of the barb into the head the plastic material of the head flows over the shoulders of the cut-out portions to anchor the barb in the head.

11 Claims, 2 Drawing Sheets

CABLE TIES

FIELD OF THE INVENTION

The invention relates to cable ties. Cable ties are used for bundling electrical cables or wires in order to ease handling.

BACKGROUND OF THE INVENTION

Cable ties generally comprise an elongate strap, commonly of a plastics material, and a head having an aperture extending through the head. The head is usually, but not necessarily formed integrally with the strap at one end thereof. The head includes a means for engaging the strap which allows the free end of the strap to be inserted into the head aperture to form a loop, and pulled through to reduce the loop size, but prevents the strap from being pulled in a reverse direction to expand the loop size.

Cable ties are known in which the head and strap engaging means are molded in one piece. This arrangement eases manufacture, but imposes a strength limitation because the engaging means, commonly a pawl, is of a plastics material. For applications requiring high strength, it has been proposed to use a metal barb extending into the head aperture at an angle to allow sliding movement of the strap in one direction only. The metal barb is embedded in the material of the head.

A cable tie with a metal barb is described in U.S. Pat. No. 3,408,699, in which a barb, referred to as prior art, is shown as having a generally rectangular body with a knife edge formed at on end thereof. The barb of the preferred embodiments of U.S. Pat. No. 3,408,699 is described as having a weakened area along a line about which the barb is to flex during and after insertion of the strap into the head aperture. Reducing the force needed to flex the barb reduces the force needed to insert and pull the strap through the aperture. It is stated that weakening can be achieved in a number of ways, including removal of material from the barb in its flexure region, making the barb thinner at or adjacent its flexure region, or by chemical treatment or annealing. With regard to the possibility of removing material from the barb at its flexure region, U.S. Pat. No. 3,408,699 shows a barb having a hole cut out of it in the region where flexure is to take place, but a possibility is indicated that the sides of the barb may tapered below the flexure line or that two holes (rather than one) may be placed at the edge or anywhere along the flexure line.

SUMMARY OF THE INVENTION

The present invention is concerned with a further improvement over the disclosure in U.S. Pat. No. 3,408,699 in cable ties with a barb of metal or other material of similar mechanical characteristics. More particularly, the present invention is concerned with improving barb retention in the head material, as well as improving, in the preferred embodiment, tolerance of the depth of insertion of the barb into the head material.

According to the invention, there is provided a cable tie comprising a head and a strap of plastics material, the head having a transverse aperture therethrough, and a barb formed separately from the head, the barb having a head engaging portion a strap engaging portion extending at least partly across the transverse aperture at an acute angle to the longitudinal axis of the transverse aperture and a region of flexure between the head engaging portion and the strap to be inserted and pulled through the transverse aperture in a first direction, due to flexure of the barb, but not in a second direction opposite to said first direction, the barb flexure region comprising a pair of opposed cut-out portions each in an edge of the barb to provide a section of reduced barb width strap engaging portion, each cut-out portion providing a shoulder at the side thereof remote from the barb free end, and the plastics material of the head being such that after insertion of the barb into the head, the plastics material of the head flows over the shoulders of the cut-out portions to anchor the barb in the head.

Each cut-out portion preferably has an inner edge portion extending parallel to the longitudinal axis of the barb, the inner edge portions of the two opposed cut-out portions defining a section of minimum barb width therebetween. The section of minimum barb width preferably extends for between 5% and 15%, and preferably 9% to 10% of the length of the barb.

Each shoulder preferably has a straight outer portion, and the outer portions may be normal to the longitudinal axis of the barb.

The barb is preferably rectangular, and the width of the section of minimum barb is preferably in the range 40% to 60% of the width of the strap engaging portion. Preferably, the width of the section of minimum barb width is 50% of the width of the strap engaging portion of the barb.

The barb preferably lies at an angle in the range 30° to 55° to a plane normal to the longitudinal axis of the transverse aperture. A preferred angle is 37°±5°, but a cable tie embodiment having an angle of 52° (tolerance +2° and −4°) is also contemplated.

BRIEF DESCRIPTION OF THE DRAWING

By way of example, one embodiment of a cable tie according to the invention will now be described with reference to the accompanying drawings, in which.

DETAILED DESCRIPTION OF THE PREFERRED EMBODIMENTS

Figure 1:
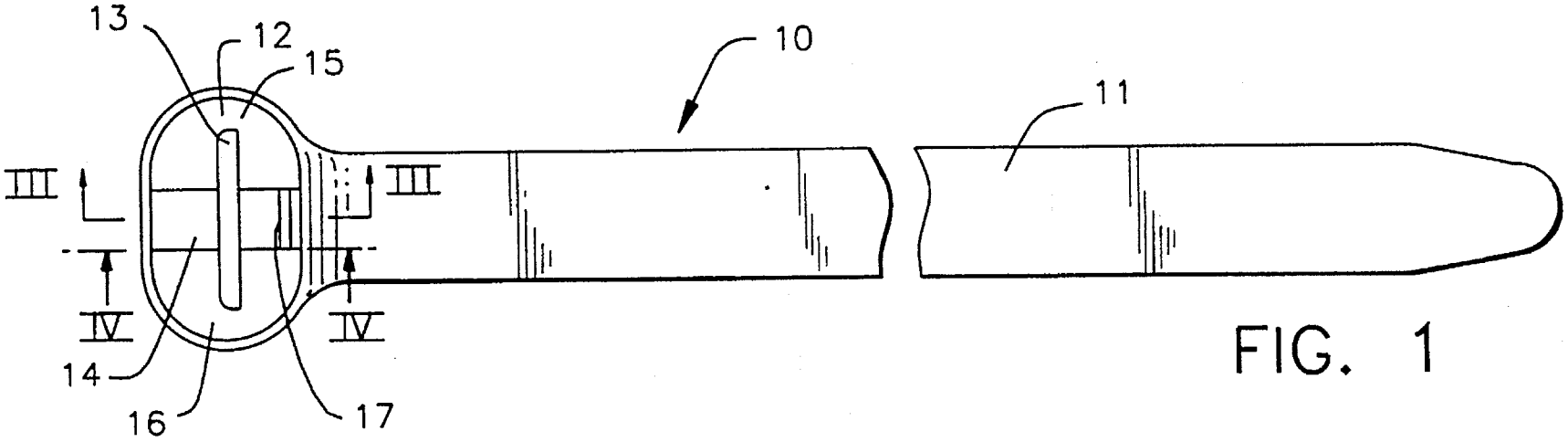
FIG. 1 is a plan view of a cable tie according to the invention before the barb is inserted.
Figure 2:
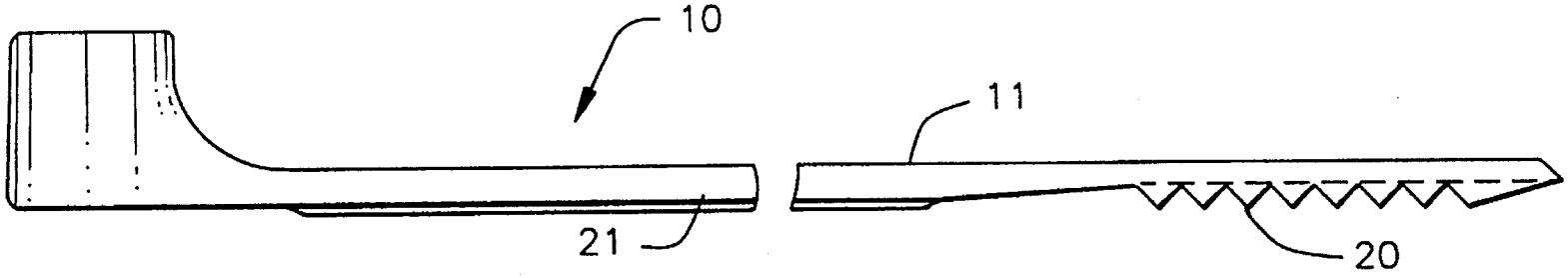
FIG. 2 is a side view of the cable tie of FIG. 1.

FIGS. 1 and 2 show a cable tie 10 of plastics material such as nylon; it will be appreciated that other plastics material could be used. The cable tie 10 has an elongate, flexible strap portion 11 and a head portion 12 all molded as a single piece. FIG. 1 shows the cable tie 10 before insertion of a strap retaining barb.

The head portion 12 has a transverse aperture 13 through which the strap portion 11 may pass and a channel 14 extending normal to the longitudinal axis of the transverse aperture 13. The channel 14 is defined by head side profiles 15, 16 and includes a tapered recess 17 on the side of the transverse aperture 13 adjacent the strap portion 11.

The strap portion 11 has a ridged end portion 20, corrugations being arranged either side of a central lead path along which a barb may travel without interruption. A main part 21 of the strap portion 11 is of a thickness greater than end portion 20.

Figure 3:
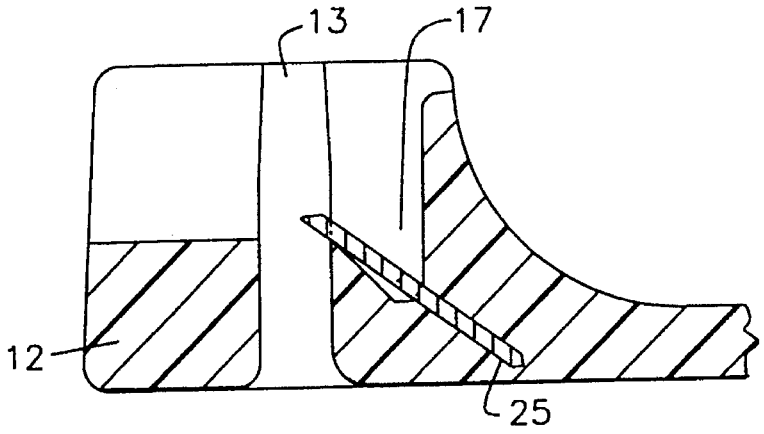
FIG. 3 is a sectional view along the lines III—III in FIG. 1 with barb inserted.
Figure 4:
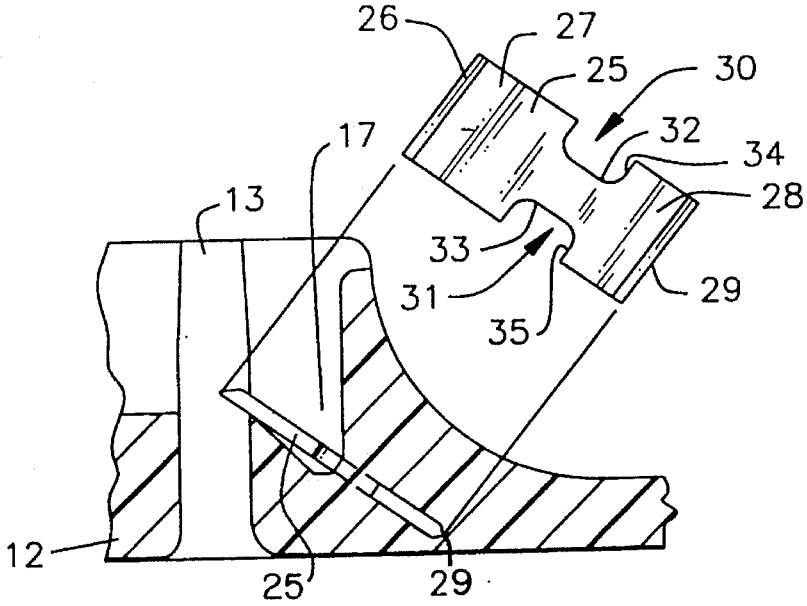
FIG. 4 is a sectional view along the lines IV—IV in FIG. 1 with the barb inserted, together with a projected view of a barb in plan.

FIGS. 3 and 4 show the head portion 12 with a barb 25 inserted into the plastics material of the head portion 12.

As shown in FIG. 4, the barb 25 is generally a rectangular section and is made of steel, although other suitable materials may be used. The barb 25 has a knife edge 26 formed at a leading edge of a strap engaging portion 27. A head engaging portion 28 is formed with a leading insertion edge 29.

Cut-out portions 30, 31 lie between the strap engaging portion 25 and the head engaging portion 28 and are formed conveniently by stamping. The cut-out portions 30 and 31 have portions 32, 33 lying parallel to the side edges of the barb 25 to define therebetween a section of minimum barb width. In the embodiment shown, the parallel portions 32, 33 extend for between 9% and 10% of the barb length, but this could be extended to a range of 5% to 15% of the barb length.

As can be seen clearly in FIG. 4, when the barb 25 is inserted into the material of the head portion 12, the head engaging portion 28 goes completely in to the material of the head portion 12 and that head portion material flows back over shoulders 34, 35 on the head engaging portion to anchor the barb in the head portion 12. The shoulders 34 and 34 both have outer portions which are straight and perpendicular to the external sides of the barb.

The barb 25 is arranged at an angle of 37°±5° to a plane normal to the central axis of the transverse aperture 13, the arrangement being such that when the strap portion 11 is passed through the transverse aperture 13, the barb is flexed at its section of minimum width defined by the cut-out portions 30, 31 to flex and thereby allow passages of the strap past the knife edge 26. Once the strap has passed through so that the barb contacts the figure portion 21 of the strap portion 11, any attempt to remove the strap will result in engagement of the knife edge 26 into the material of the strap portion 11.

Figure 5:
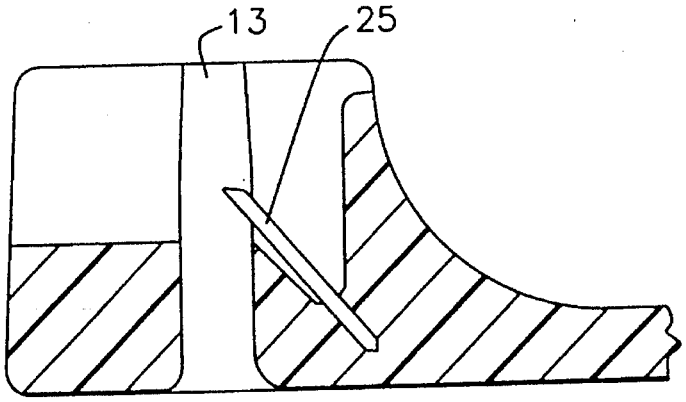
FIG. 5 is a sectional view similar to that of FIG. 4 but with the barb at an alternative angle.

FIG. 5 shows an alternative embodiment in which the barb 25 lies at an angle of 52° (tolerance +2° and −4°) to a plane normal to the longitudinal axis of the aperture 13. The greater angle of the barb in the FIG. 5 embodiment eases insertion of the strap portion 11.

The barb width between the straight edges of the cut-out portions 32, 33 is approximately 50% of the width of the remainder of the barb. It will be appreciated that this is a preferred width and that variations, for example between 40% and 60% of the width may be used. A length of the straight portions 32, 33 may also be varied; the purpose of the straight portions 32, 33 are to provide the same width of barb at its flexing portion while allowing for some tolerance in the depth of insertion of the barb into the end portion 12.

It will be appreciated that variations in materials of the cable tie and the barb, together with variations and modifications to the embodiment described may be made within the scope of the invention as defined herein.

I claim:

1. A cable tie comprising a head and a strap of plastics material, the head having a transverse aperture therethrough, and a barb formed separately from the head, the barb having a head engaging portion a strap engaging portion extending at least partly across the transverse aperture at an acute angle to the longitudinal axis of the transverse aperture, and a region of flexure between the head engaging portion and the strap engaging portion to allow the strap to be inserted and pulled through the transverse aperture in a first direction, due to flexure of the barb, but not in a second direction opposite to said first direction, the barb flexure region comprising a pair of opposed cut-out portions each in an edge of the barb to provide a section of reduced barb width between the cut-out portions relative to the width of the strap engaging portion, each cut-out portion providing a shoulder at the side thereof remote from the barb free end, and the plastics material of the head being such that after insertion of the barb into the head, the plastics material of the head flows over the shoulders of the cut-out portions to anchor the barb in the head.

2. A cable tie as claimed in claim 1 wherein each shoulder has a straight outer portion.

3. A cable tie as claimed in claim 2 wherein the shoulder portions are normal to the longitudinal axis of the barb.

4. A cable tie as claimed in claim 1 wherein each cutout portion has an inner edge portion extending parallel to the longitudinal axis of the barb, the inner edge portions of the two opposed cut-out portions defining a section of minimum barb width therebetween.

5. A cable tie as claimed in claim 4 wherein the section of minimum barb width extends for between 5% and 15% of the length of the barb.

6. A cable tie as claimed in claim 5 wherein the section of minimum barb width extends for between 9% and 10% of the length of the barb.

7. A cable tie as claimed in claim 5 wherein the barb is rectangular and the width of the section of minimum barb width is between 40% and 50% of the width of the strap engaging portion.

8. A cable tie as claimed in claim 7 wherein the width of the section of minimum barb width is 50% of the strap engaging portion of the barb.

9. A cable tie as claimed in claim 1 wherein the barb lies at an angle in the range 30° to 55° to a plane normal to the longitudinal axis of the transverse aperture.

10. A cable tie as claimed in claim 9 wherein the barb angle is 37°±5°).

11. A cable tie as claimed in claim 9 wherein the angle is 52° (tolerance +2° and −4°).

* * * * *